US006393677B1

(12) United States Patent
Anscher

(10) Patent No.: US 6,393,677 B1
(45) Date of Patent: May 28, 2002

(54) FIVE-WAY BUCKLE

(76) Inventor: Joseph Anscher, 1928 Midlane, Muttontown, NY (US) 11791

( * ) Notice: Subject to any disclaimer, the term of this patent is extended or adjusted under 35 U.S.C. 154(b) by 0 days.

(21) Appl. No.: 09/696,884

(22) Filed: Oct. 26, 2000

(51) Int. Cl.[7] ..... A44B 11/25
(52) U.S. Cl. ..... 24/630; 24/615
(58) Field of Search ..... 24/198, 318, 502, 24/602, 606, 607, 614, 615, 620, 630, 631, 632, 633, 634, 635, 637, 642, 573.1, 573.3, 573.5, 573.6, 656; 280/801.1, 808; 297/464–469

(56) References Cited

U.S. PATENT DOCUMENTS

| | | | | |
|---|---|---|---|---|
| 3,925,853 A | * | 12/1975 | Nicklin | 24/312 |
| 4,302,049 A | | 11/1981 | Simpson | |
| 4,606,552 A | * | 8/1986 | Hultqvist | 24/633 X |
| 4,740,030 A | * | 4/1988 | Nordskog | 297/13 |
| 4,809,410 A | * | 3/1989 | Van Riesen | 24/633 X |
| 5,438,737 A | * | 8/1995 | Anscher et al. | 24/630 |
| 5,659,931 A | * | 8/1997 | Anscher | 24/614 |
| 5,732,907 A | | 3/1998 | Limbach | |
| 5,908,223 A | * | 6/1999 | Miller | 297/467 X |
| 6,049,954 A | * | 4/2000 | Britto | 24/573.1 |
| 6,076,894 A | * | 6/2000 | Busch | 297/484 |

FOREIGN PATENT DOCUMENTS

| | | | |
|---|---|---|---|
| EP | 0 094 211 | | 5/1983 |
| EP | 0 225 719 | | 11/1985 |
| GB | 2 036 853 | | 7/1980 |
| GB | 2 180 293 A | * | 3/1987 |
| GB | 2 286 851 | | 8/1995 |

* cited by examiner

*Primary Examiner*—Anthony Knight
*Assistant Examiner*—Ruth C. Rodriguez
(74) *Attorney, Agent, or Firm*—Collard & Roe, P.C.

(57) ABSTRACT

A five-way buckle for a harness system having two shoulder straps, two waist straps and a crotch strap, comprises a center base section having at least one female buckle receptacle, and at least one male buckle section. The male buckle section has a bar for threading a waist belt therethrough and a male buckle portion adapted for releasable locking engagement with the female buckle receptacle on the center base section. There is at least one D-ring formed by a ring portion disposed on the male buckle section and a second ring portion disposed on the center base section. The free ends of the two ring portions meet to form the D-ring when the male buckle section is locked to the center base section. This D-ring is used to secure a shoulder strap to the buckle assembly. The shoulder strap is then immediately released when the male section is removed from the center base section, which causes the ring portions to separate.

19 Claims, 10 Drawing Sheets

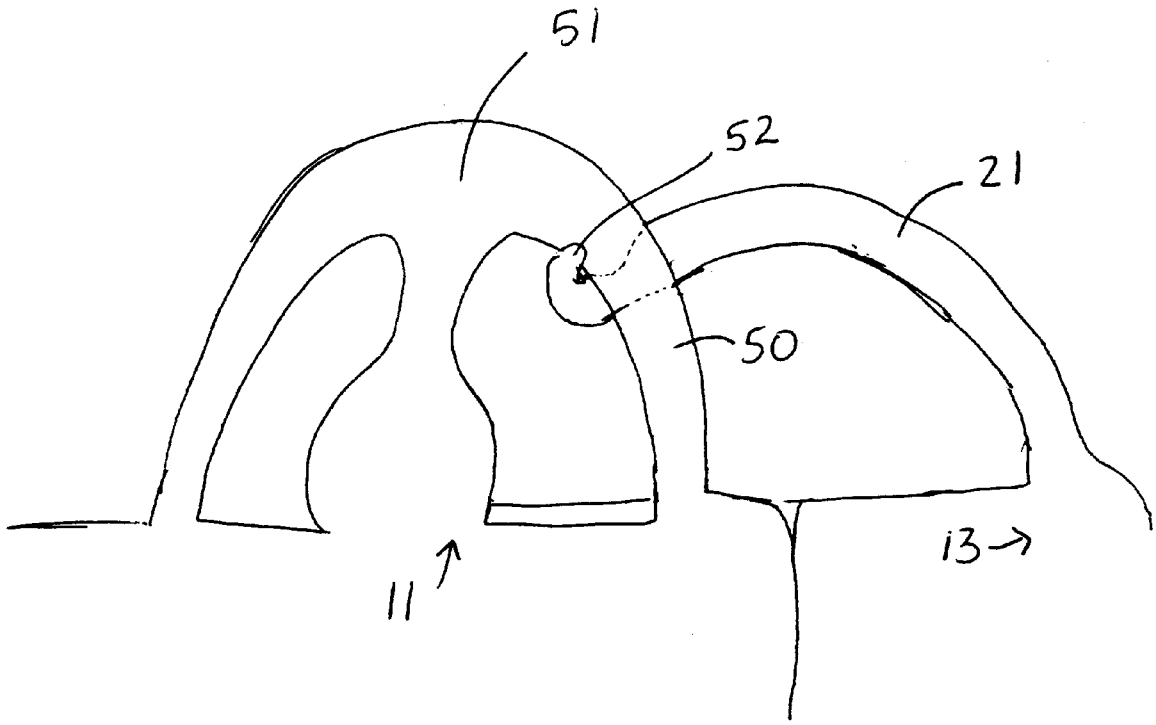
5A

FIVE-WAY BUCKLE

BACKGROUND OF THE INVENTION

1. Field of the Invention

This invention relates to a buckle that is used in a five-point harness restraint for infant and child strollers. In particular, the invention relates to a buckle for a five-point harness that releases the shoulder straps entirely from the buckle system when the waist straps are released, to prevent accidental strangulation.

2. The Prior Art

In traditional five-point restraint systems, the shoulder straps and waist straps are formed from a single strap having a seatbelt-like sliding buckle. When the buckle is inserted into the center push portion, the strap forms both a waist belt and a shoulder belt. This system is suitable for restraining a child, but can create a risk of strangulation if the buckle is released and the child remains in the stroller or car seat. This is because the single strap forms a loop with the seat and rear wall of the stroller or car seat, and this loop can catch a child's head if the child begins to slide out of the stroller or car seat.

SUMMARY OF THE INVENTION

It is therefore an object of the invention to provide a buckle for use with a five-point harness system that eliminates any risk of strangulation when the buckle is released.

It is another object of the invention to provide a buckle for a five-point harness that is simple to manufacture and operate.

These and other objects are accomplished by a five-way buckle for a harness-system having two shoulder straps, two waist straps and a crotch strap, comprising a center base section having at least one female buckle receptacle and at least one male buckle section. The male buckle section has means for threading a waist belt therethrough and a male buckle portion adapted for locking engagement with the female buckle receptacle on the center base section. There are means for releasing the male buckle sections from the center base section. There is a D-ring formed by a ring portion disposed on the male buckle section and a second ring portion disposed on the center base section. The two ring portions meet to form the D-ring when the male buckle section is locked to the center base section. This D-ring is used to secure a shoulder strap to the buckle assembly via a snap hook or other means.

The ring portions may be symmetrical, such as two quarter-circles that meet to form a semicircular shape, or may be assymetrical, such as an L-shaped member on one section, and a post on the other section, that meet to form a D-ring as well. Any suitable shape for the ring portions could be used, as long as they retain a hook when locked, and easily release the hook when opened.

In a preferred embodiment, there are two female buckle receptacles located on opposite sides of the center base section, and two male buckle sections, so that two D-rings are formed from two ring portions on the center base section and one ring portion on each male buckle section. This way, the buckle can be used to secure two shoulder straps to the D-rings. In addition, the center base section preferably has a bar located opposite the D-rings for attaching a crotch strap. The buckle can then be used to create a secure 5-point harness for a stroller or other item.

The means for releasing the male buckle sections can comprise either a center push button on the center base portion, or take the form of a side-release buckle. The center push button presses locking legs on the male buckle portion together and forces the male buckle section out of engagement with the center base portion. With the side-release buckle, there are a plurality of apertures in the center base section for receiving flexible locking legs on the male buckle portions. The locking legs protrude through the apertures when the male buckle section is locked to the center base section. Pressing the locking legs together releases the male buckle sections from the center base section.

In one embodiment, the two ring portions on the center portion are integrally formed with each other from a single piece, with the free ends of the ring portions facing away from each other. For example, the two ring portions on the center base section may be formed by a single inverted triangular unit attached to the center base portion and having concave side walls forming the ring portions. The inverted triangular unit preferably has a top ledge that overlaps the ring portions on the male buckle sections when the male buckle sections are locked to the center base section.

The inverted triangular unit may have an aperture extending through a central portion of the unit, and the ring portions on the male buckle sections may have at least one aperture extending therethrough. This "honeycomb" type of arrangement makes the pieces stronger, by preventing cracking through the whole width of the pieces.

In another embodiment, the ring portions on the male and center sections each have free ends that face each other when the male buckle section is locked to the center base section, but the free ends do not touch. The shoulder strap is kept securely in place because its location of contact with the D-ring is not directly at the split between the rings, but off to one side. However when the male buckle section is separated from the center base section, the rings open up and the shoulder strap is easily released from the buckle.

In another embodiment, one ring portion has a protrusion on its free end, and the corresponding other ring portion has a cutout corresponding to the shape of the protrusion on its free end, so that the protrusion fits within the cutout when the male buckle section is locked to the center base section. This creates a more secure fit, and creates the appearance of a continuous one-piece ring formed from the two buckle sections. Alternatively, the protrusion and indentation are located only on one half of the width, or on only one face side of the ring portions. The other half of the width or face side of the ring portions forms a finger, so that the fingers overlap when the male buckle section is locked into the center base section.

In yet another embodiment, the ring portions on the center base section are comprised of a semicircular loop having two ends attached to the center base portion, and a central post extending from the center base portion and attached to the apex of the semicircular piece. The central post has ledges on opposite sides thereof for receiving the ends of the ring portions of the male buckle sections when the male buckle sections are locked to the center base section.

The free end of one of the ring portions can have an interlocking male member, such as a hook, that locks into a corresponding female area on the other ring portion, to secure the two ring portions together. The hook is located at a lower height than the female member, to avoid interference when the male buckle section is being secured to the center base section, but engages the female area when the male buckle section is locked in. This is because under load, the hook is forced up to engage the female area and locks the ring portions together.

In a further embodiment, the center base section does not have any ring portions. Each male buckle section has one ring portion, that meets the ring portion on the other male buckle section to form the D-ring over the center base section when the male buckle sections are locked to the center base section. This way, two shoulder straps or one strap can be clipped to the D-ring thus formed. In addition, each male buckle section can also have additional strap bars for attaching waist straps or other straps.

The cross section of the snap hook is wide enough so that it extends beyond the tip of each ring portion, so that it is absolutely necessary to have the two ring portions put together to keep the hook in place. This way, the hook cannot become inadvertently caught on a single ring portion, and pose a strangulation hazard. The wider the hook is relative to the length of each ring portion, the easier it is for the hook to escape when the ring portions are apart. In addition, a wider hook cross section increases the interference between the hook and the two ring portions together, thereby controlling the amount of "pull-apart" force between the hook and the D-rings.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 5A shows a partial rear view of the embodiment in FIG. 5;

DETAILED DESCRIPTION OF THE PREFERRED EMBODIMENTS

Figure 1:
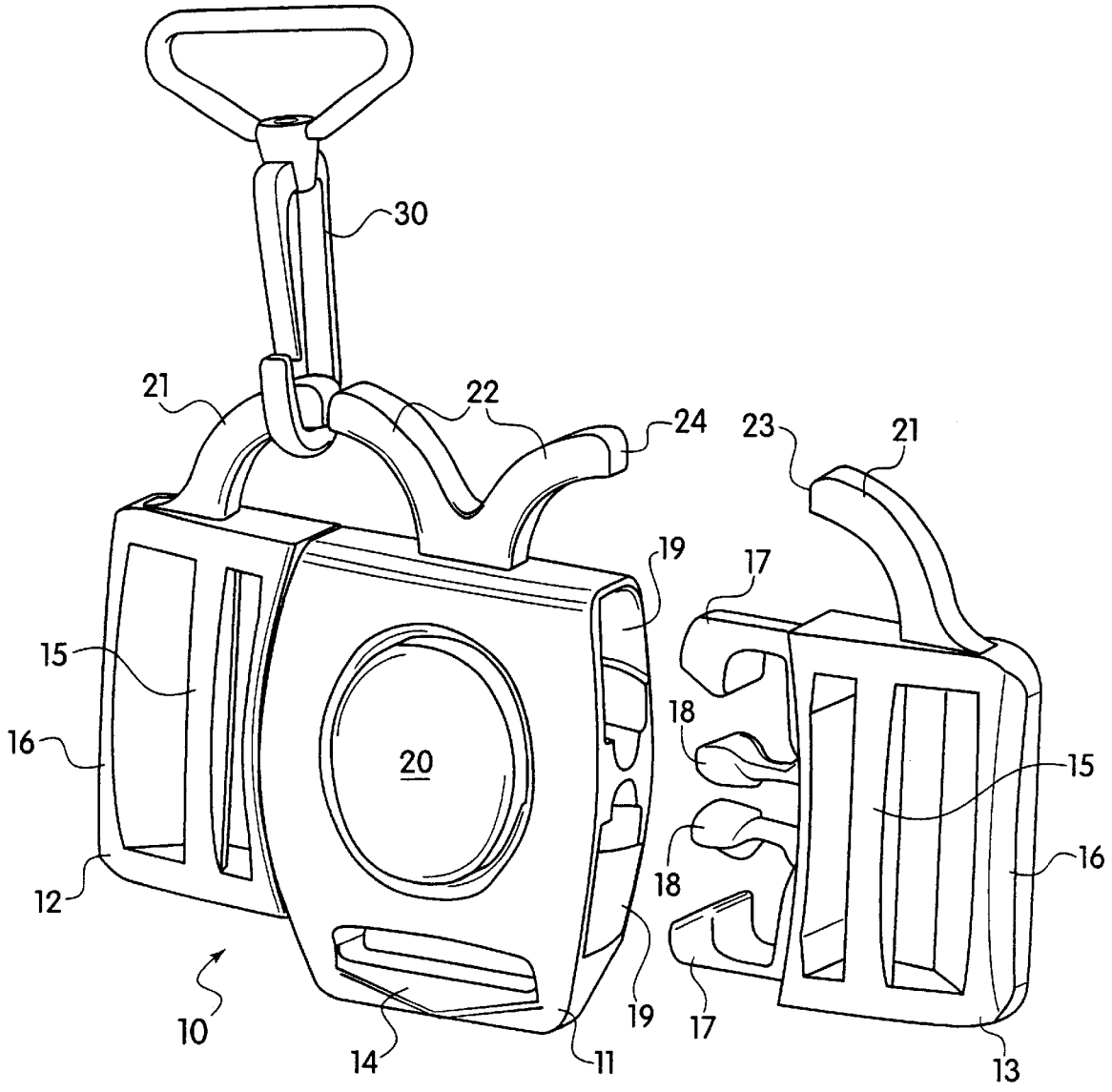
FIG. 1 shows a perspective view of a first, embodiment of the invention, with one side released.
Figure 2:
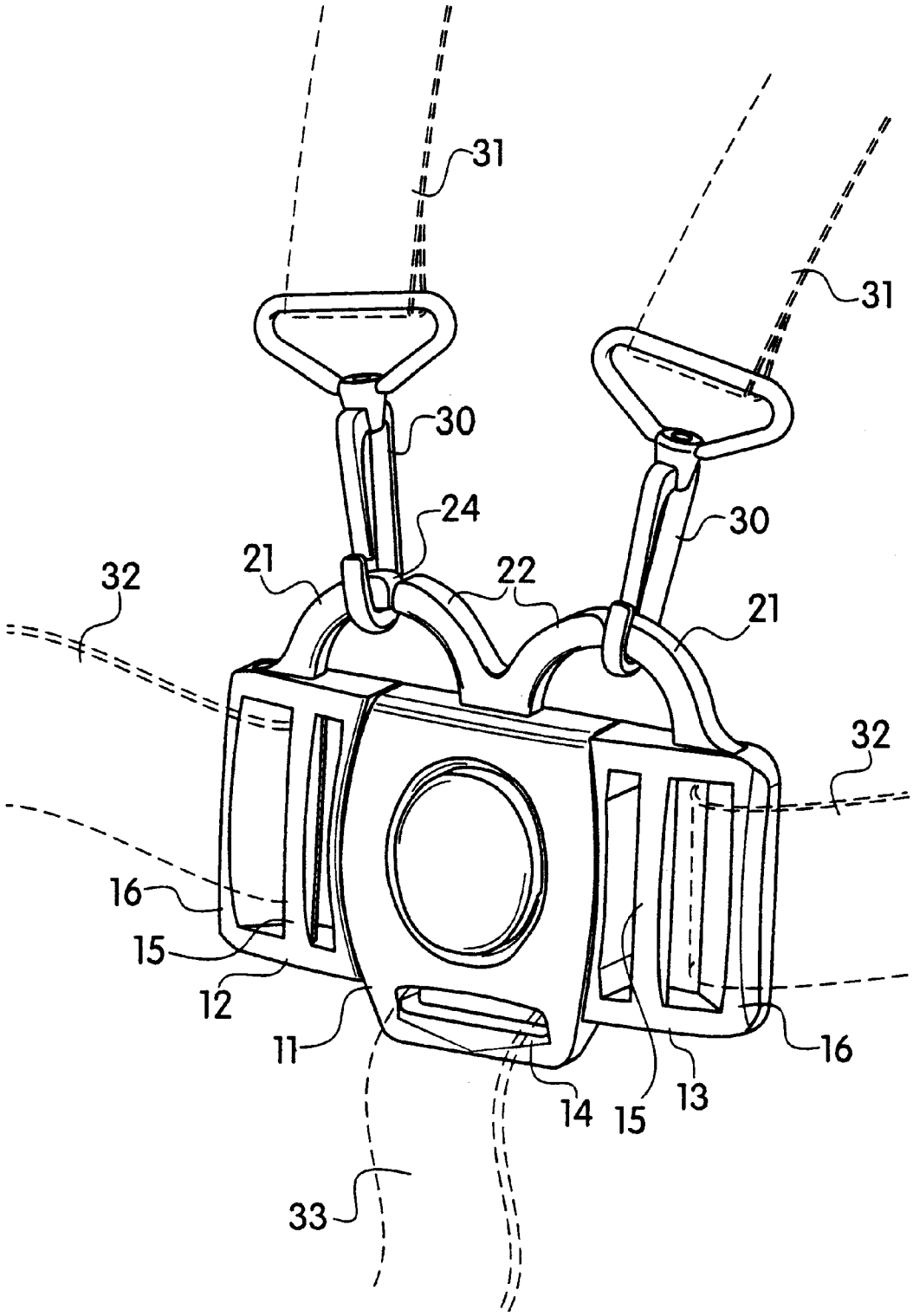
FIG. 2 shows a perspective view of the embodiment of FIG. 1, attached to shoulder, waist and crotch straps of a five-point harness.

Referring now in detail to the drawings, FIGS. 1 and 2 show buckle 10 according to the invention. Buckle 10 is comprised of a center base section 11 and two male buckle sections 12 and 13. Center base section 11 has a bar 14 for attaching a crotch strap 33, when buckle 10 is to be used with a 5-point harness system as shown in FIG. 2. Male buckle sections 12, 13 also have bars 15 and 16 for adjustably threading waist straps 32 therethrough. Male buckle sections 12, 13 have a buckle portion formed from outer locking legs 17 and inner locking legs 18, which are inserted into buckle receptacles in the form of channels 19 in center base section 11 and locked into place to secure male buckle sections 12, 13 to center base section 11. Pressing center push button 20 releases locking legs 17 and 18 to eject male buckle section 12 from center buckle section 11. The mechanism for a center push button type buckle is well known and not described or shown in detail here. Traditionally, the center push button will release both male sections simultaneously. Here, only one side is shown released for illustrative purposes. Alternatively, there can be a separate center push button for each of the male buckle sections, so that each section is individually released.

To attach shoulder straps 31 via snap hooks 30, two D-rings are formed on buckle 10 by ring portions 22 on center buckle section 11 and corresponding ring portions 21 on male buckle sections 12. When male buckle sections 12, 13 are locked into center buckle section 11, free ends 23 of ring portions 21 meet free ends 24 of ring portions 22 to form a complete D-ring for securing snap hook 30. In the embodiment shown in FIGS. 1 and 2, the free ends do not meet, but leave a gap having a width smaller than the width of the snap hook, so that the snap hook cannot become disengaged without unlocking the buckle or the snap hook.

To release snap hook 30, center push button 20 is pressed, which causes male buckle sections 12, 13 to release and open the D-ring. Thus, snap hook 30 and shoulder strap 31 are completely detached from buckle 10. This reduces the risk of strangulation as compared to other five point harnesses, in which the shoulder straps are formed in one piece with the waist straps, forming a loop that can strangle a child.

Figure 3:
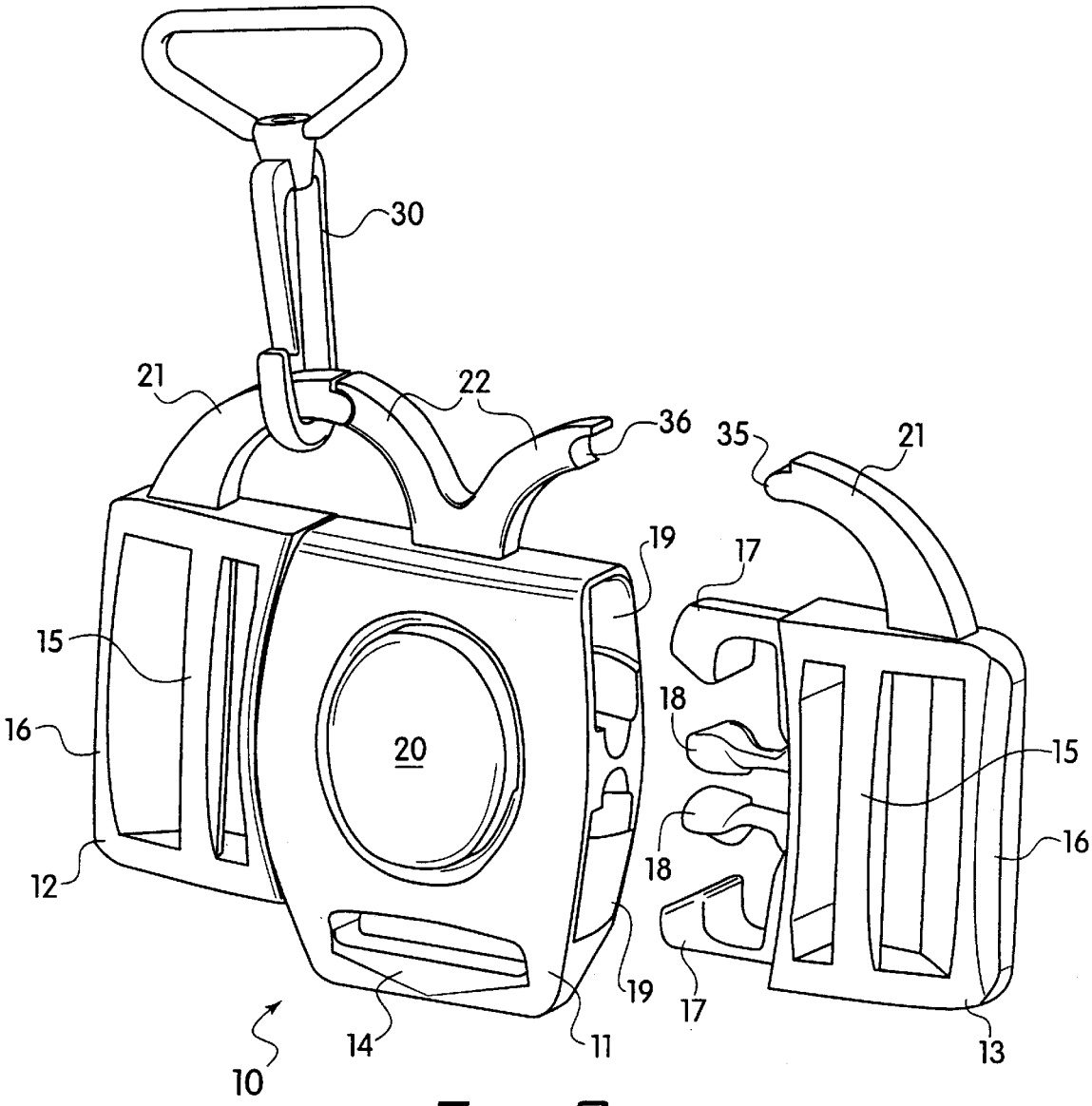
FIG. 3 shows a perspective view of a second embodiment of the invention, with one side released.

FIG. 3 shows an alternative embodiment of buckle 10. In this embodiment, the free ends of ring portions 21 form a protrusion 35, and the free ends of ring portions 22 form a corresponding indentation 36, so that protrusions 35 fit snugly within indentations 36 when male buckle sections 12 are snapped into center base section 11. This creates a smooth, one-piece look for the D-ring.

Figure 4:
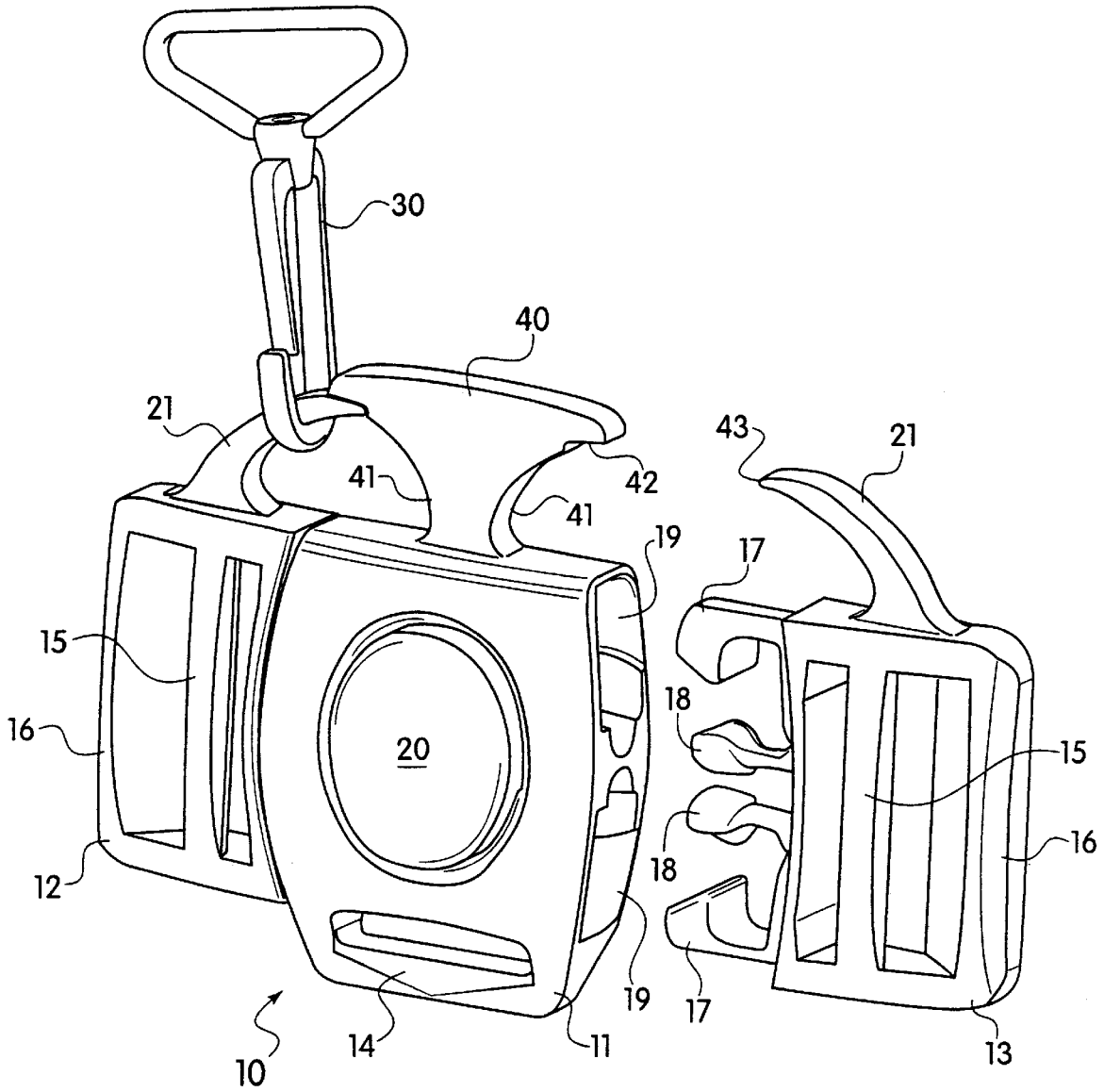
FIG. 4 shows a perspective view of a third embodiment of the invention, with one side released.

FIG. 4 shows another alternative embodiment of buckle 10. In this embodiment, center base section 11 has an inverted triangular section 40, having two concave side walls 41, which form half of the D-ring. Triangular section 40 has a top ledge portion 42. Male buckle sections 12, 13 comprise curved ring portions 21 having a pointed tip that fits underneath top ledge portion 42 of center base section 11 when male buckle sections 12, 13 are snapped into center base section 11. Top ledge portion 42 prevents any upward flexing of ring portion 21 and creates a secure D-ring for attaching a strap thereto.

Figure 5:
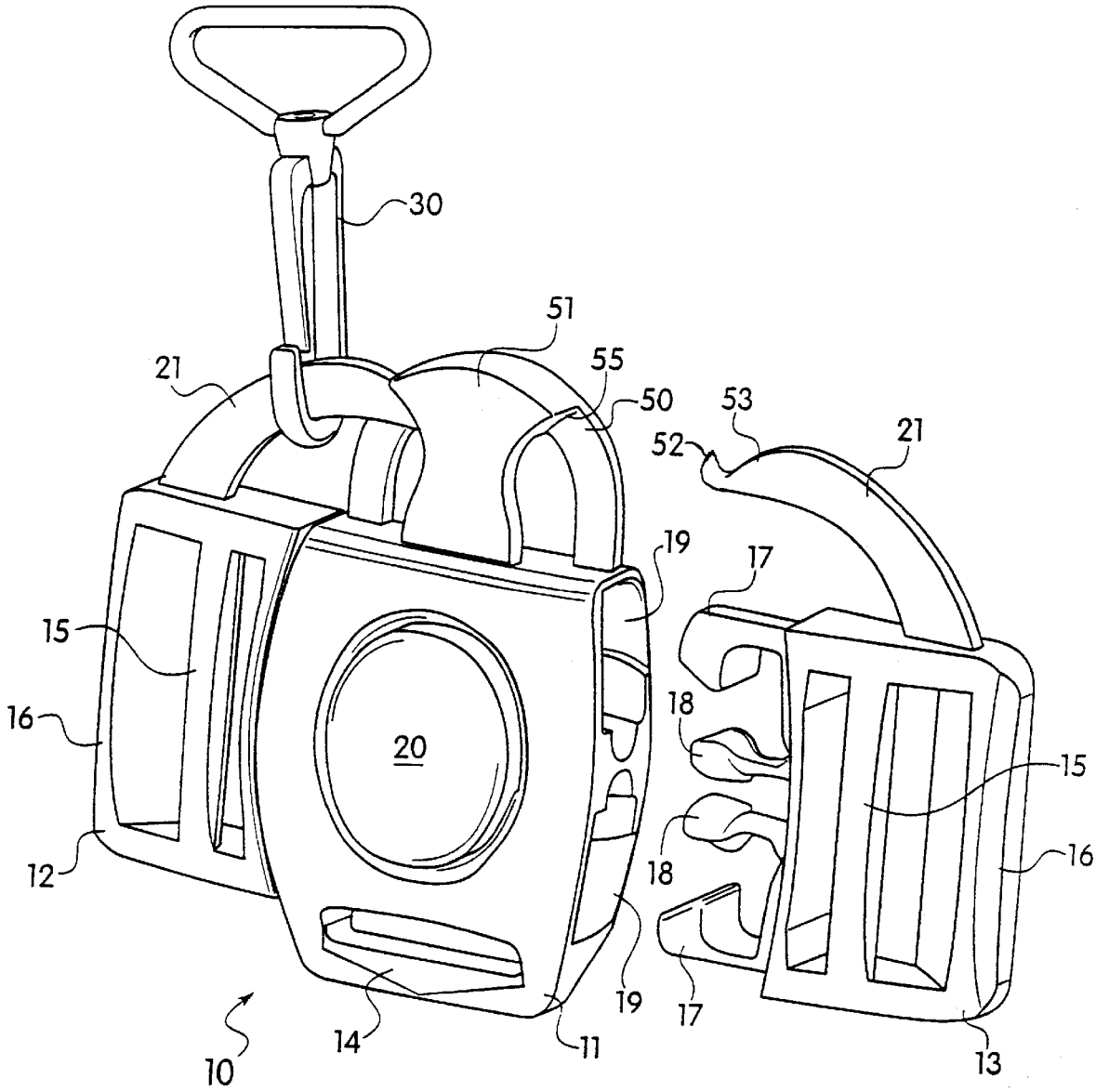
FIG. 5 shows a perspective view of a fourth embodiment of the invention, with one side released.

FIG. 5 shows another embodiment of buckle 10. In this embodiment, center base section 11 has a semicircular loop 50 on its top side. There is a center post 51 extending up from center base section 11 and meeting loop 50 at its apex. Loop 50 occupies one face side of center base section 11, while post 51 occupies the other face side of base section 11, so that a ledge 55 is formed where post 51 and loop 50 meet. Male buckle sections 12 and 13 have a ring portion 21, having a curved end 53 and a male interlocking member in the form of a projecting hook 52. When male buckle sections 12 and 13 are snapped into center base section 11, hook 52 hooks around loop 50 as shown in FIG. 5A, to create a secure, smooth looking D-ring for securing hook 30. Hook 52 is actually at a height lower than that shown in FIG. 5A, but when male buckle section 13 is snapped into center base section 11 and a snap hook is attached thereto, the tension from the snap hook causes hook 52 to rise up and fit securely under loop 50, as shown in FIG. 5A. Other means for securing hook 52 could also be used.

Figure 6:
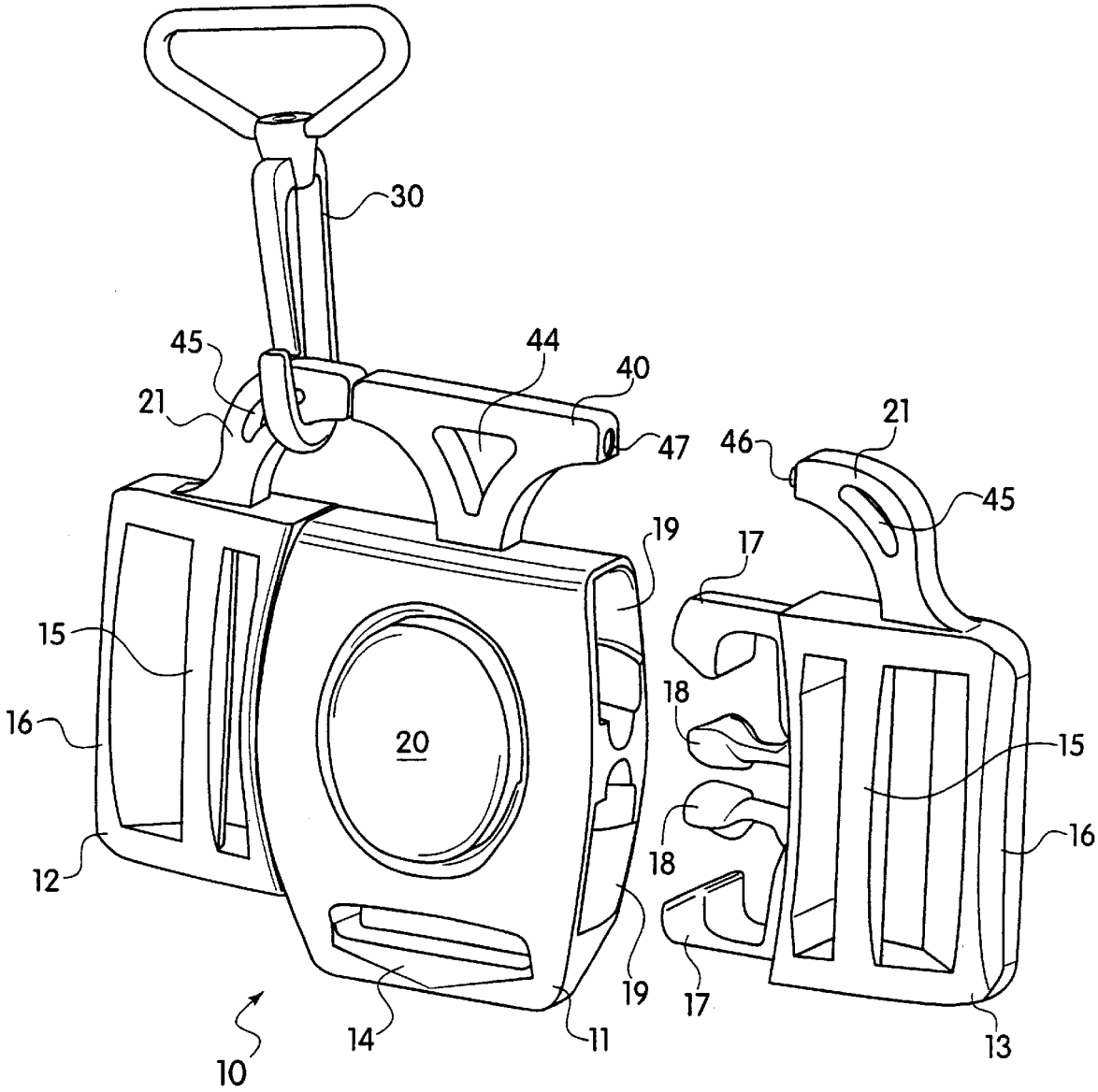
FIG. 6 shows a perspective view of a fifth embodiment of the invention, with one side released.

FIG. 6 shows a fifth embodiment of the invention, which is similar to the embodiment shown in FIG. 4. In this embodiment, inverted triangular section 40 has an aperture 44 therethrough. Ring portions 21 each have an aperture 45 therethrough. The apertures in the D-ring sections strengthen the ring portions and triangular section and prevent cracking of the entire piece. The end of ring portion 21 has a plug 46, that fits within indentation 47 on inverted triangular section 40, to secure ring portion 21 to inverted triangular section 40 when the male buckle sections 12, 13 are inserted into center base section 11.

Figure 7:
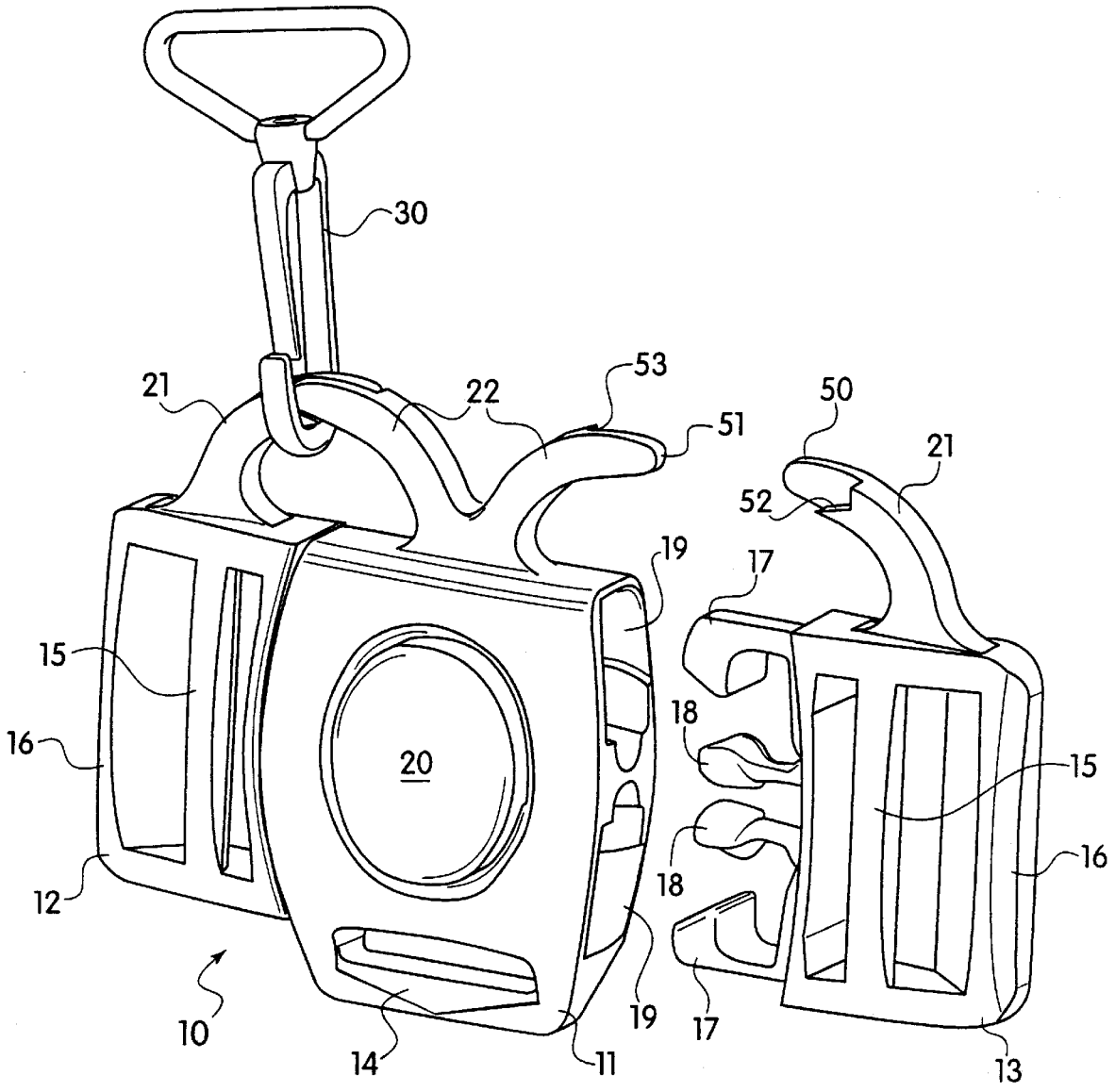
FIG. 7 shows a perspective view of a sixth embodiment of the invention, with one side released.

FIG. 7 shows a sixth embodiment of buckle 10 according to the invention. In this embodiment, ring portions 21 each have a projecting finger 50, which extends only along one face side of ring portion 21. The other face side of ring portion 21 has an indentation 52. Similarly, ring portion 22 has a projecting finger 51 that extends only along one face side of ring portion 22. The other face side has a protrusion 53 that corresponds in shape to the shape of indentation 52 on ring portion 21. When male buckle sections 12, 13 are locked into center base section 11, fingers 50 and 51 overlap, and protrusion 53 fits within indentation 52 to create a smooth secure D-ring for attaching snap hook 30.

Figure 8:
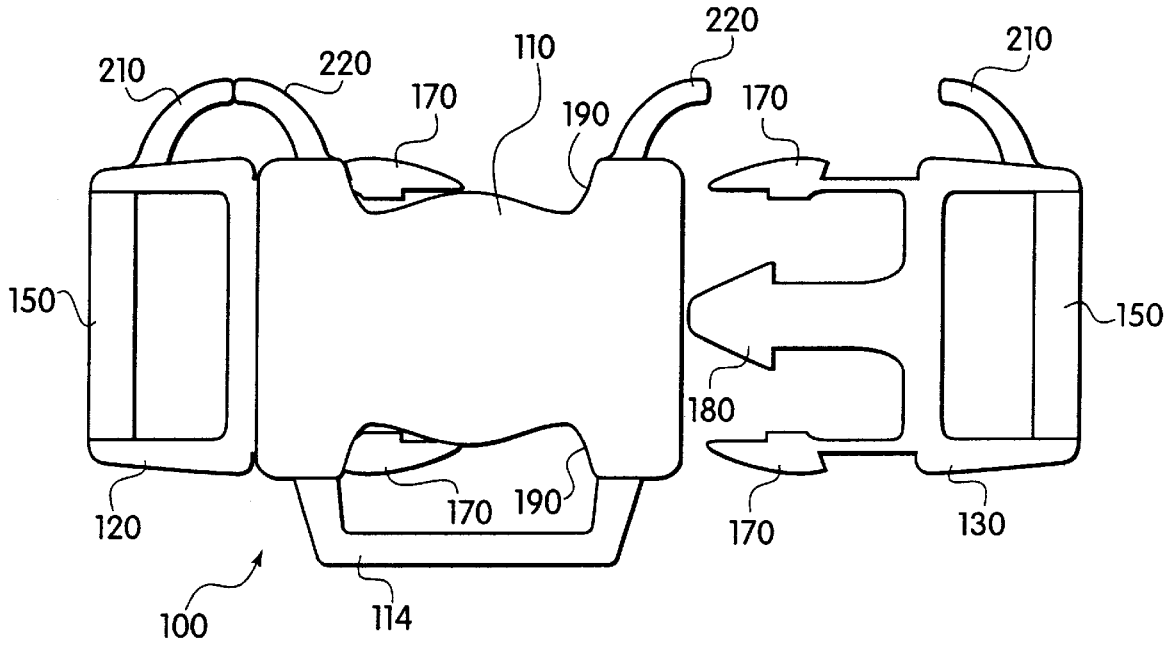
FIG. 8 shows a perspective view of a seventh embodiment of the invention, with one side released.

A seventh embodiment of the buckle 100 is shown in FIG. 8. This embodiment shows a traditional side-release type buckle, instead of a center push buckle, as shown in FIGS. 1–7. Buckle 100 has a center base section 110 and two male buckle sections 120 and 130. There is a bar 114 on center base section 110 to secure a crotch strap thereto. There is also a bar 150 on each of male buckle sections 120, 130 for securing a waist strap thereto. Male buckle sections 120, 130 have a buckle portion formed from outer locking legs 170 and an inner leg 180. Center base section 110 has apertures 190 to receive legs 170 on male buckle sections 120, 130. Legs 170 snap into apertures 190 to lock male buckle sections 120, 130 to center base section 110. To release them, legs 170 are pressed inward until they clear aperture 190 and push male buckle sections 170, 180 outward. Buckle 100 has ring portions 210 on male buckle sections 120, 130, and has ring portions 220 on center base section 110. Ring portions 220 meet with ring portions 210 when male buckle sections 120, 130 are pressed into center base section 110, to form a D-ring for securing a shoulder strap thereto. Any of the variations of the D-ring shown in FIGS. 1–7 can also be used with the embodiment of FIG. 8.

Figure 9:
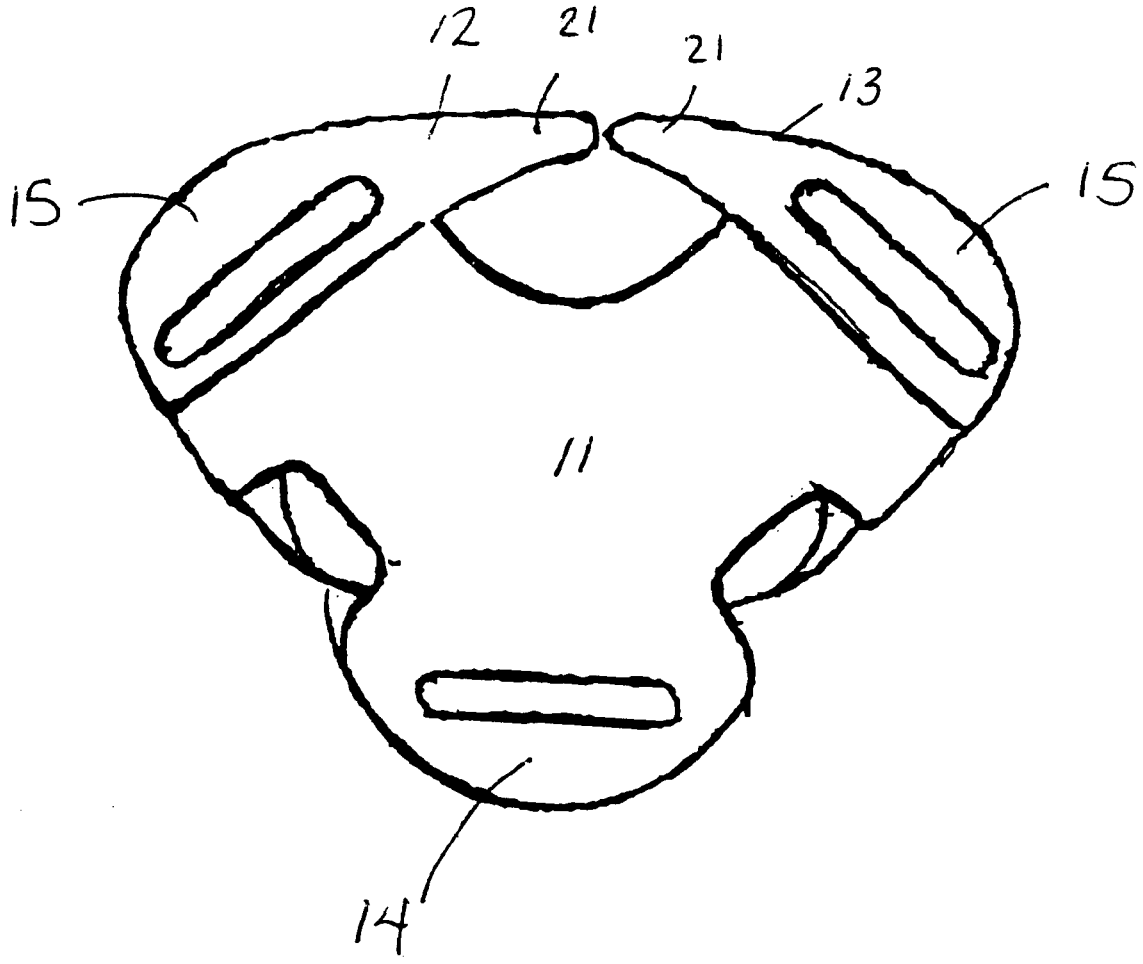
FIG. 9 shows a front view of an eighth embodiment of the invention, with both sides locked.

FIG. 9 shows yet another embodiment of the invention. In this case, a D-ring is formed by ring portions 21 on male buckle sections 12, 13. Center base section 11 has no ring portions, and merely forms the bottom side of the D-ring thus formed. Waist strap bars 15 are formed on male buckle sections 12, 13 as well. The mechanism for attaching male buckle sections 12, 13 to center base section is known and is disclosed in U.S. Pat. No. 5,438,737, the disclosure of which is herein incorporated by reference. In this embodiment, two snap hooks are attached to the single D-ring formed by ring portions 21, so that two shoulder straps are attached to the buckle.

Accordingly, while only a few embodiments of the present invention have been shown and described, it is obvious that many changes and modifications may be made thereunto without departing from the spirit and scope of the invention.

What is claimed is:

1. A buckle for use with a harness system having at least one shoulder strap; comprising:

a center base section having at least one female buckle receptacle;

at least one male buckle section having a male buckle portion adapted for locking engagement with said at least one female buckle receptacle on the center base section;

means for releasing said male buckle section from said center base section;

a D-ring formed by a ring portion disposed on said at least one male buckle section and a second ring portion disposed on said center base section, such that when said male buckle section is locked to said center base section, said two ring portions meet and form a D-ring for securing the shoulder strap thereto.

2. The buckle according to claim 1, wherein the means for releasing the male buckle section comprises at least one center push button on the center base portion.

3. The buckle according to claim 1, wherein a free end of one of the ring portions has a male interlocking member and the other ring portion has a corresponding female area, wherein the interlocking portion engages the female area to secure the two ring portions together when the male buckle sections are locked to the center base portion.

4. The buckle according to claim 1, further comprising a mechanism on each of the male buckle sections for attaching a waist strap thereto.

5. A buckle for use with a harness system having at least one shoulder strap; comprising:

a center base section having two female buckle receptacles located on opposite sides of said center base section;

two male buckle sections each having a male buckle portion adapted for locking engagement with said female buckle receptacles on the center base section;

means for releasing said male buckle sections from said center base section;

a ring portion disposed on each male buckle section and and two ring portions on said center base section, so that two D-rings are formed by said ring portions when said male buckle sections are inserted into said center base section.

6. The buckle according to claim 5, wherein said center base section further comprises a bar for threading a strap therethrough.

7. The buckle according to claim 6, wherein said bar is located on a side opposite the ring portions so that a crotch strap is attachable to said bar and shoulder straps are attachable to said D-rings.

8. The buckle according to claim 5, wherein said two ring portions on said center portion are integrally formed with each other.

9. The buckle according to claim 5, wherein said ring portions on said center base section are comprised of a semicircular loop having two ends attached to said center base portion, and a central post extending from said center base portion and attached to said semicircular loop at an apex thereof.

10. The buckle according to claim 5, wherein said two ring portions on said center base section are formed by a single inverted triangular unit attached to said center base section and having concave side walls forming the ring portions.

11. The buckle according to claim 10, wherein said inverted triangular unit has a top ledge that overlaps said ring portions on said male buckle sections when said male buckle sections are locked to said center base section.

12. The buckle according to claim 10, wherein said inverted triangular unit has an aperture extending through a central portion of said unit, and wherein said ring portions on said male buckle sections have at least one aperture extending therethrough.

13. A buckle for use with a harness system having at least one shoulder strap; comprising:

a center base section having at least one female buckle receptacle;

at least one male buckle section having a male buckle portion adapted for locking engagement with said at least one female buckle receptacle on the center base section;

means for releasing said male buckle section from said center base section;

a D-ring formed by a ring portion disposed on said at least one male buckle section and a second ring portion disposed on said center base section, such that when said male buckle section is locked to said center base section, said two ring portions meet and form a D-ring for securing the shoulder strap thereto, wherein the buckle is a side release buckle and wherein the means for releasing said male buckle section comprises at least one aperture in said center base section, and wherein the male buckle portion comprises at least one flexible locking leg that protrudes through said aperture when said male buckle section is locked to said center base section, and wherein pressing said at least one locking leg releases said male buckle section from said center base section.

14. A buckle for use with a harness system having at least one shoulder strap; comprising:

a center base section having at least one female buckle receptacle;

at least one male buckle section having a male buckle portion adapted for locking engagement with said at least one female buckle receptacle on the center base section;

means for releasing said male buckle section from said center base section;

a D-ring formed by a ring portion disposed on said at least one male buckle section and a second ring portion disposed on said center base section, such that when said male buckle section is locked to said center base section, said two ring portions meet and form a D-ring for securing the shoulder strap thereto, wherein said two ring portions each have free ends that face each other when said male buckle section is locked to said center base section, forming a semicircular shape, and wherein the free ends do not touch.

15. A buckle for use with a harness system having at least one shoulder strap; comprising:

a center base section having at least one female buckle receptacle;

at least one male buckle section having a male buckle portion adapted for locking engagement with said at least one female buckle receptacle on the center base section;

means for releasing said male buckle section from said center base section;

a D-ring formed by a ring portion disposed on said at least one male buckle section and a second ring portion disposed on said center base section, such that when said male buckle section is locked to said center base section, said two ring portions meet and form a D-ring for securing the shoulder strap thereto, wherein one ring portion has a protrusion on its free end, and the other ring portion has a cutout corresponding to the shape of the protrusion on its free end, such that said protrusion fits within said cutout when said male buckle section is locked to said center base section.

16. The buckle according to claim 15, wherein said protrusion and indentation are located only on one face side of said ring portions, and wherein the other face side of said ring portions forms a finger such that said fingers overlap when said male buckle section is locked into said center base section.

17. A buckle for use with a harness system having at least one shoulder strap; comprising:

a center base section having at least one female buckle receptacle;

at least one male buckle section having a male buckle portion adapted for locking engagement with said at least one female buckle receptacle on the center base section;

means for releasing said male buckle section from said center base section;

a D-ring formed by a ring portion disposed on said at least one male buckle section and a second ring portion disposed on said center base section, such that when said male buckle section is locked to said center base section, said two ring portions meet and form a D-ring for securing the shoulder strap thereto, wherein a free end of one of the ring portions has a male interlocking member and the other ring portion has a corresponding female area, wherein the interlocking portion engages the female area to secure the two ring portions together when the male buckle sections are locked to the center base portion and wherein the male interlocking member comprises a hook.

18. A buckle for use with a harness system having at least one shoulder strap, comprising:

a center base section having two female buckle receptacles;

two male buckle sections each having a male buckle portion adapted for locking engagement with said female buckle receptacles on the center base section;

means for releasing said male buckle section from said center base section;

a D-ring formed by a ring portion disposed on one male buckle section and a second ring portion disposed on the other male buckle section, such that when said male buckle sections are locked to said center base section, said two ring portions meet and form a D-ring for securing the shoulder strap thereto.

19. The buckle according to claim 18, wherein each of the male buckle sections has a mechanism for attaching a waist strap thereto.

* * * * *